United States Patent [19]

Zelina, Jr.

[11] 4,218,637

[45] Aug. 19, 1980

[54] FLASHER CIRCUIT

[75] Inventor: John H. Zelina, Jr., Fairview, Pa.

[73] Assignee: Lighting Systems, Inc., Erie, Pa.

[21] Appl. No.: 900,798

[22] Filed: Apr. 27, 1978

[51] Int. Cl.[2] ..... H05B 35/00; F21L 7/00

[52] U.S. Cl. ..... 315/313; 315/200 A; 315/209 R; 315/320; 362/184; 362/228

[58] Field of Search ..... 315/200 A, 312, 313, 315/320, 362, DIG. 7, 209 R; 362/157, 184, 227, 228, 236, 251; D48/24 R, 24 A

[56] References Cited

U.S. PATENT DOCUMENTS

| | | | |
|---|---|---|---|
| D. 233,251 | 10/1974 | Lawrance | D48/24 R |
| D. 247,457 | 3/1978 | Zelina | D48/24 R |
| 2,695,403 | 11/1954 | Stoker et al. | 362/157 X |
| 2,726,321 | 12/1955 | Riotto | D48/24 A X |
| 3,435,206 | 3/1969 | Swanson | 315/DIG. 7 |
| 3,955,078 | 5/1976 | Eggers et al. | 362/228 X |
| 4,023,067 | 5/1977 | Zelina et al. | 315/209 R |

FOREIGN PATENT DOCUMENTS

| | | | |
|---|---|---|---|
| 1489401 | 4/1969 | Fed. Rep. of Germany | 362/227 |

*Primary Examiner*—Eugene R. LaRoche
*Attorney, Agent, or Firm*—Charles L. Lovercheck

[57] ABSTRACT

A combination floodlight, spotlight and flasher circuit is disclosed herein. The circuit is provided with a manual switch means, which will turn a spotlight to on, off, and flash, and turn the floodlight on, off, and to a battery saver position. The floodlight is operated through a unique inverter circuit and flasher circuit combination. Multiple combinations of switching modes make it possible to selectively accomplish various combinations of lights simultaneously.

7 Claims, 3 Drawing Figures

FLASHER CIRCUIT

GENERAL STATEMENT OF THE INVENTION

The light, according to the invention, provides a combination of floodlight for use where a large amount of light is needed in a local area; a spotlight for spotting objects at a distance; and a light flasher that can be used for safety as to warn traffic when an automobile tire is to be changed on the road. The flasher circuit includes an improved amplification type circuit and the floodlight is operated by a low power consumption circuit.

REFERENCE TO PRIOR ART

The inverter circuit disclosed in combination with the lamp herein is similar to the circuit shown in U.S. Pat. No. 4,023,067, but has certain improvements therein. A combination flood and spotlight is shown in U.S. Pat. No. Des. 247,457, issued on Mar. 7, 1978.

OBJECTS OF THE INVENTION

It is an object of the invention to provide an improved combination flasher, flood and spotlight circuit.

Another object of the invention is to provide a circuit for a combination flasher, flood and spotlight that is simple in construction, economical to manufacture, and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

GENERAL DESCRIPTION OF THE DRAWINGS

DETAILED DESCRIPTION OF THE DRAWINGS

Figure 1:
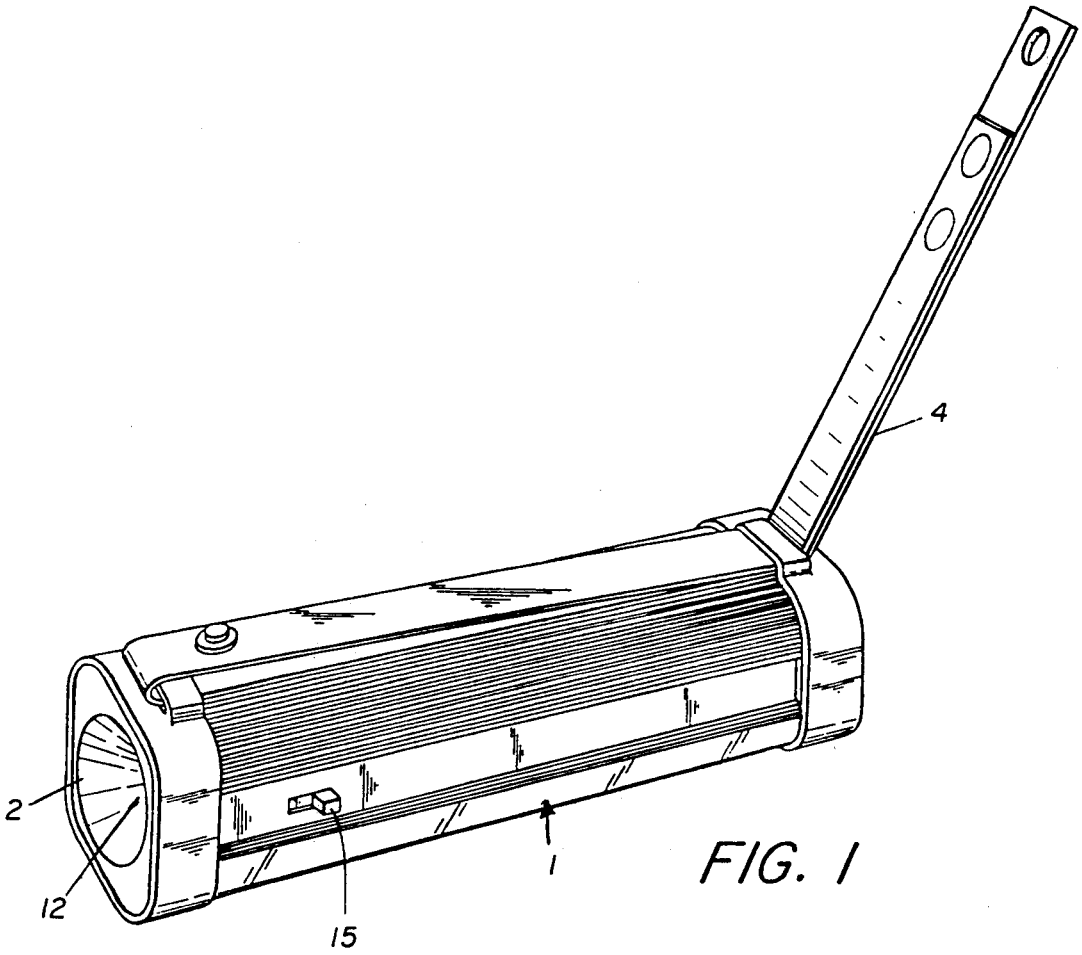
FIG. 1 is an isometric view of the light according to the invention.
Figure 2:
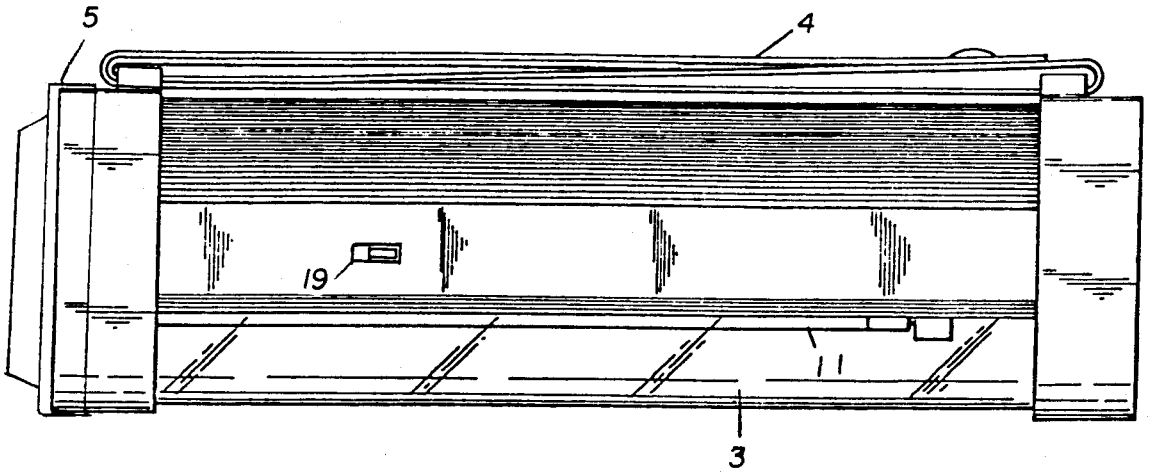
FIG. 2 is a side view of the light shown in FIG. 1 with a colored overcap over its spotlight end.
Figure 3:
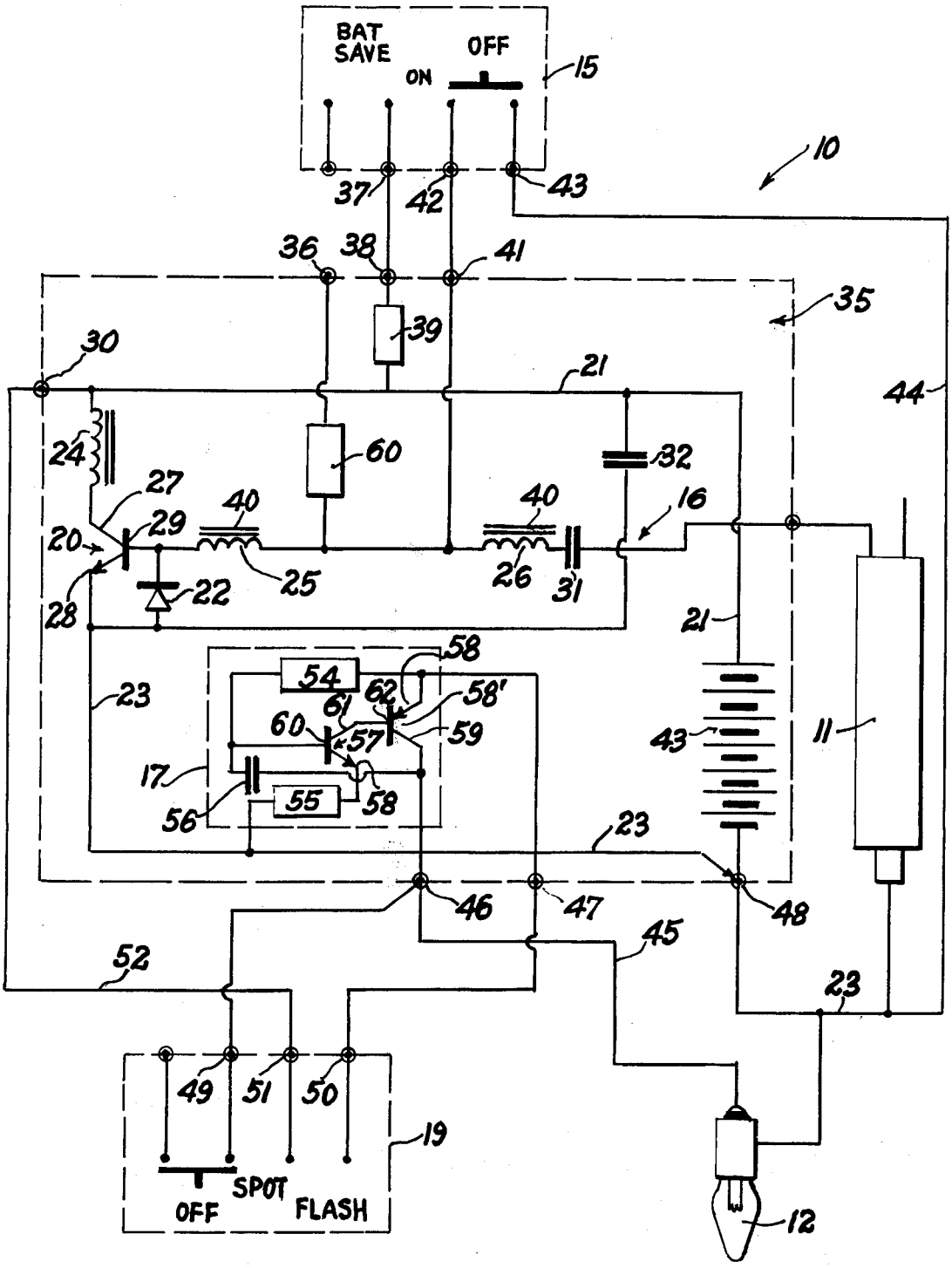
FIG. 3 is a schematic diagram of the flasher-flood-spotlight circuit shown on a printed circuit board according to the invention.

Now, with more particular reference to the drawings, the light 1 has a spot lens 2 and a flood lens 3 and a strap 4. A colored light transmissive cap 5 snaps over the spot lens 2 for flasher service. The circuit 10, according to the invention, has flood lamp 11 and spot lamp 12 and power means, which is a battery 13, and two switches 15 and 19, which constitute switch means for connecting the floodlamp 11 and the spotlamp 12 to the battery 13. The printed circuit board carries the electronic components and has terminals 30, 34, 36, 38, 41, 46, 47 and 48 to which lamps 11 and 12, battery 13, and switches 15 and 19 are connected. The spotlamp 12 has one side connected through conductor 23 to the terminal 48. The other terminal on the spotlamp 12 is connected through conductor 45 to the terminal 46. The fluorescent floodlamp 11 is connected to terminals 34 and 48. The fluorescent lamp is connected to the inverter circuit by means of the switch 15 and the incandescent lamp is connected to the battery 13 by switch means 19.

The inverter circuit 16 is similar to the inverter circuit shown in U.S. Pat. No. 4,023,067, but has certain improvements that will appear herein. The battery 13 is connected to the conductor 23 and to terminal 48 on one side. The other terminal of the battery is connected through conductor 21 to terminal 30, primary winding 24 of the transformer, resistor 39, and capacitor 32. The transistor 20 has base 29 connected to the secondary winding 25 of the transformer and to diode 22. The collector 27 of the transistor is connected to the primary winding 24. The emitter 28 of the transistor is connected to conductor 23, diode 22 to capacitor 32 and to conductor 33. Conductor 44 connects secondary winding 25 of the transformer to secondary winding 26, resistor 60 and terminal 41. Base 29 of the transistor is connected in series with the secondary windings 25 and 26 and capacitor 31 to terminal 34. The terminal 41 is connected in series with resistor 60 and terminal 36. Resistor 39 is connected to conductor 21 and to terminal 38 on the printed circuit board. The terminals 38 and 41 on the printed circuit board are connected to terminals 37 and 42 on the switch 15, while the terminals 30, 46 and 47 on the printed circuit board are connected to terminals 51, 49 and 50, respectively, on switch 19.

The flasher circuit 17 is made up of electrical valves 57 and 58' connected together in an amplification type circuit. Valve 57 may be an NPN valve; valve 58' may be a PNP valve, together with resistors 54 and 55 and capacitor 56. The resistor 55 connects the emitter 58 of the valve 57 to terminal 48 on the PC Board by way of Line 23. The resistor 54 has one side connected to terminal 47 on the PC Board and the other side connected to capacitor 56 and to the base 60 of the valve 57. The collector 61 of valve 57 is connected to the base 62 of the valve 58', while the emitter 63 of valve 58' is connected to terminal 47. The collector 59 of valve 58' is connected to terminal 46.

It will be seen that when the switch 19 is moved to connect the terminals 49 and 51 together, the spotlight lamp 12 will be energized constantly.

When the switch 19 is moved to a position connecting lines 50 and 51 together, the incandescent lamp 12 will be supplied power through the flasher circuit 17 so it will flash intermittently, and when switch 19 connects terminals 49 and 60, the spotlight will be in "off" position.

When the switch 15 is moved to connect terminals 42 and 43, the fluorescent floodlamp 11 will be "off". When the switch 15 is moved to connect terminal 42 to terminal 37, the inverter circuit will begin to operate energizing the fluorescent light. After the fluorescent light is energized, switch 15 may be moved to connect terminal 37 to terminal 36', which puts resistor 39 and resistor 60 in series. Resistor 60 can be any value greater than zero to infinity. The inverter circuit will then operate in a purely resonant mode as described in U.S. Pat. No. 4,023,067. The inverter circuit operates in a higher degree of efficiency reducing input power thus reducing battery consumption in this mode.

It can be noted that any combination of switching modes of switch 15 and switch 19 can be accomplished simultaneously.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. In combination, a light having an ionizable gas-containing lamp and an incandescent lamp,
an inverter circuit,
a flasher circuit,
a battery,
switch means,
said switch means being adapted to selectively connect said battery and said inverter circuit and said ionizable gas-containing lamp in series with each other whereby said ionizable gas-containing lamp is energized,
said switch means having further means to connect said flasher circuit, said incandescent lamp and said battery in series with each other whereby said incandescent lamp flashes,
said switch having further means connected to said battery and said incandescent lamp to connect said incandescent lamp directly to said battery, whereby said incandescent lamp is energized constantly,
said inverter circuit includes said ionizable gas-containing lamp,
capacitor means,
a first inductive means,
a second inductive means,
a third inductive means,
switching means having a control element,
said ionizable gas-containing lamp, said capacitor means, and said first and second inductive means being connected in series with each other,
said switching means having a first power element and a second power element,
said ionizable gas-containing lamp, said capacitor means and said first and second inductive means comprising,
a control circuit,
and said third inductive means and said first power element and said second power element being connected in series with each other and comprising,
a power circuit,
said control circuit being connected to said control element of said switching means,
magnetic coupling means connecting said first inductive means, said second inductive means, and said third inductive means together,
and means for connecting a power source to said power circuit whereby current flows in said third inductive means and induces current in said first inductive means and said second inductive means.

2. The combination recited in claim 1 wherein said flasher circuit comprises,
an NPN element and a PNP element connected in an amplification arrangement to said incandescent lamp.

3. The combination recited in claim 1 wherein said control circuit comprises,
a resonant circuit.

4. The combination recited in claim 1 wherein said magnetic coupling means comprises,
a transformer having a primary winding and first and second secondary windings,
said primary winding comprising said third inductive means, and
said secondary windings comprising said first and second inductive means.

5. The combination recited in claim 4 wherein said secondary windings are connected in series with each other and a resistor is connected to the junction between said secondary windings and a terminal on said switch means is connected to said resistor.

6. The inverter circuit recited in claim 4 wherein said switching means comprises,
a transistor having its base emitter and collector comprising,
switch terminals connected in series with said primary winding and its base comprising,
said control element connected to a secondary winding.

7. The combination recited in claim 4 wherein said capacitor means and said secondary windings are connected in series with said ionizable gas-containing lamp comprising,
a resonant circuit.

* * * * *